United States Patent [19]

Schoenfeld

[11] 4,259,800

[45] Apr. 7, 1981

[54] DISPLAY APPARATUS AND ASSOCIATED CIRCUIT

[76] Inventor: Alexander Schoenfeld, 39 Sycamore La., Roslyn Heights, N.Y. 11577

[21] Appl. No.: 11,507

[22] Filed: Feb. 12, 1979

[51] Int. Cl.[3] ..... G09F 13/04

[52] U.S. Cl. ..... 40/444; 40/573; 40/581; 40/902

[58] Field of Search ..... 40/442, 444, 573, 581, 40/582, 902, 576, 575, 579; 340/701, 702, 703, 792, 800; 315/314, 315, 318, 323

[56] References Cited

U.S. PATENT DOCUMENTS

| | | | |
|---|---|---|---|
| 983,593 | 2/1911 | Wortley | 40/576 |
| 2,511,411 | 6/1950 | Mitchell | 40/576 |
| 2,631,274 | 3/1953 | Doherty et al. | 340/701 X |
| 3,402,491 | 9/1968 | Wagner | 40/573 X |
| 3,710,379 | 1/1973 | Bruinsma | 340/380 X |
| 3,772,874 | 11/1973 | Lefkowitz | 340/800 X |
| 3,789,387 | 1/1974 | Hurst | 340/380 X |
| 3,806,722 | 4/1974 | Peake et al. | 40/444 |
| 3,862,505 | 1/1975 | Jeroma | 40/574 |
| 4,055,014 | 10/1977 | Schmidt et al. | 40/442 |
| 4,139,957 | 2/1979 | Minogue | 40/572 |

*Primary Examiner*—John F. Pitrelli
*Assistant Examiner*—G. Lee Skillington
*Attorney, Agent, or Firm*—Posnack, Roberts, Cohen & Spiecens

[57] ABSTRACT

A display apparatus is provided comprising a plurality of spaced lights with reflectors operatively associated with the lights which are isolated from one another. A circuit is provided for actuating the lights for selected periods of time to create an appearance of sequencing. Shaped lenses having the form of alphabetic characters or the like are associated with the lights and are illuminated thereby to achieve a desired effect. The reflectors and seperators associated therewith are connected together in a monolithic structure. The reflectors are asymmetrically formed in the case of asymmetrically shaped alphabetic characters in order to direct the light most appropriately through the shaped lenses. Sequencing is provided by the use of a binary counter, the output of which selectively actuates the lights.

12 Claims, 5 Drawing Figures

18
22
20
10
24
16
30
28
26
40
42
44
46
48
50
68
62
12
52
54
56
58
60
64
66
86
84
92
88
90
14
80
82

DISPLAY APPARATUS AND ASSOCIATED CIRCUIT

FIELD OF INVENTION

This invention relates to advertising and display apparatus and more particularly to electric signs adapted to provide special lighting effects such as sequencing.

BACKGROUND

When electric signs were originally employed, the designs were cut into opaque material and lights were placed behind the opaque material to make the designs stand out. As new techniques became available, designs were formed by light bulbs and in some cases by neon tubes or the like.

In various electric signs, circuits are provided such that some lights are on while other lights are turned off and the sign illuminates first one design and then another. Some of the modern signs display movement and this is achieved by an automatic switching between light bulbs and other such sources of illumination.

One type of electric sign employs transilluminated elements employing translucent plastic or glass. Light sources inside of such signs make messages and designs on the translucent plastic or glass more clearly visable.

The most significant qualities of an electric sign are brightness and clarity. The sign is designed to be bright so that it can be effectively seen. The sign is preferrably made clear so that it can be easily read.

Bulbs must be spaced at appropriate distances so that their fields of light will not interfere with one another. A sign should be evenly lighted so that each letter and part of the associated design stands out and is clear.

Competition between signs has led to the use of brighter light and the use of electric signs for advertising has become so widespread that vast industries have been built on the same. Most signs are, however, extremely costly and this is especially so where some form of sequencing is provided for the various lights incorporated therein.

SUMMARY OF THE INVENTION

It is an object of the invention to provide a sophisticated display apparatus capable of providing a sequencing of lights, but at a lower cost than heretofore available.

Yet another object of the invention is to provide an improved display apparatus in which the lighting elements are most effectively employed.

Another object of the invention is to provide an improved display apparatus wherein transfers between colors may be effectively and economically obtained.

In achieving the above and other objects of the invention, there is provided a display apparatus comprising a plurality of spaced lights, reflectors operatively associated with respective of said lights, first means for optically isolating said lights, second means for actuating said lights for selected periods of time to create an appearance of sequencing, and third means optically associated with respective of said lights to be illuminated thereby to generate a decorative appearance.

In accordance with further aspects of the invention, the aforesaid third means may include shaped lenses and these shaped lenses may be more particularly in the shape of alphabetic characters or the like.

In accordance with another feature of the invention, the aforesaid reflectors and first means may be connected together in a monolithic structure. In such construction, the aforesaid lights extend through the reflectors which may each include a relatively flat base and opposite end portions extending angularly from said base, said base being provided with openings for the passage of said lights.

In accordance with a feature of the invention where the shaped lenses are at least partly asymmetrically shaped, said end portions are also at least asymmetrically shaped to optimize light directed through the lenses. Moreover, said end portions will be partly symmetrically shaped to account for the divergence of light as guided along an optical path by the said lenses.

In accordance with another aspect of the invention, the display apparatus will comprise a casing for supporting the reflectors, first means and third means. Said casing will include a plurality of vertically disposed angles with said third means also including a plurality of vertically disposed angles for cooperating with the first said angles for the support and location of said third means. Said monolithic structure will be captured between said casing and third means. Moreover, locking means may be provided on the casing and third means to hold the same together.

In accordance with another aspect of the invention, said second means may include a power pack to supply power to said lights in parallel and means for selectively connecting said power to and isolating said power from said lights. Moreover, a pair of said lights may be provided for each of said reflectors and one of each pair of lights may include a colored lens for a change of color, said lights forming two sets, one of the sets including said colored lenses.

According to still another feature of the invention, said second means may include a clock circuit generating a sequence of pulses and a binary counter to count said pulse and to actuate said lights according the count. Said counter may be adapted to selectively actuate one of the lights associated with each reflector at a time dependent upon the count. Moreover the counter may cause a switching back and forth between said sets of lights. Still further, said counter may include a plurality of output terminals exceeding by one in number, the number of said pairs of lights, said apparatus further comprising a switching circuit actuated by the extra output terminal to switch between said sets. Driver circuits may be provided between said counter and lights.

The above and other objects, features and advantages of the invention will be found in the detailed description which follows hereinafter as illustrated in the accompanying drawing.

DETAILED DESCRIPTION

In accordance with the invention, there is provided a display apparatus adapted for providing a lighting sequence by means of a microprocessor or an equivalent circuit of a type to be described in greater detail hereinafter. As a consequence of the provisions of the invention, an effective light display is provided at a relatively low cost in order to achieve a sophisticated type of lighting display which heretofore was available only at great cost to the user.

Figure 1:
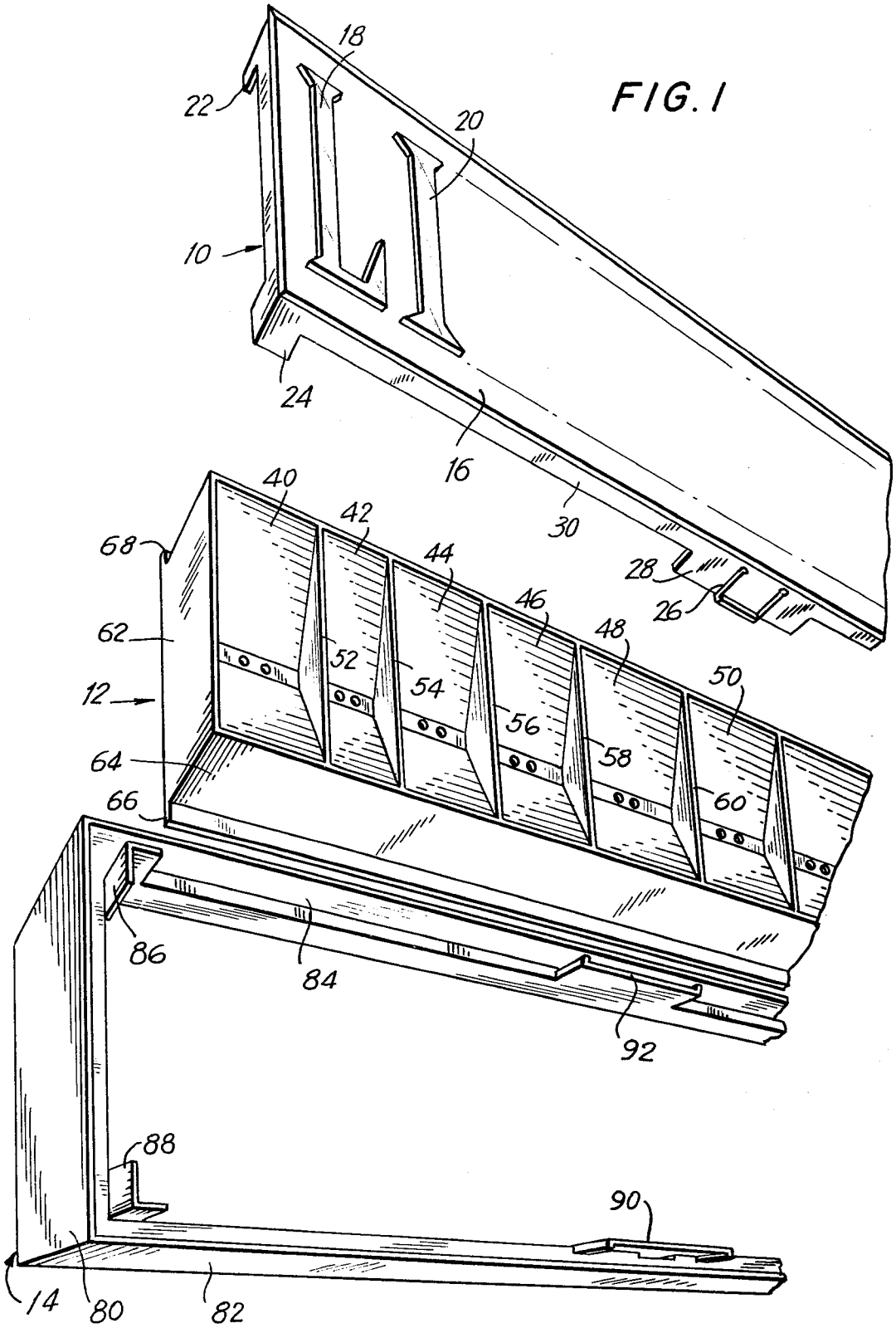
FIG. 1 is a fragmentary exploded view in perspective of a display apparatus provided in accordance with a preferred embodiment of the invention.

In FIG. 1 are shown three basic components of the display apparatus of the invention, namely components 10, 12 and 14. Component 10 is a monolithic structure formed with a face 16 preferably of a translucent plastic or glass. Formed thereon, in a plurality of fields, are respective shaped lenses such as indicated at 18 and 20 for displaying indicia. Additional shaped lenses are provided along the longitudinal extent of the component 10 and, in the illustrated embodiment of the invention, these shaped lenses take the form of alphabetic characters or the like.

The alphabetic characters are preferably shaped lenses formed out of a transparent plastic or out of a transparent glass. In order that these lenses should be monolithic with the face 16, it is possible that the face 16 and the associated alphabetic characters be cast of a single material with the face 16 being subsequently covered with a paint or some other such translucent substance which will permit the illumination of the face without any bright light shining through. The passage of bright light is confined to the shaped lenses such as indicated at 18 and 20 which operate in conjunction with light bulbs and reflectors as will be discussed hereinafter.

Additionally appearing in FIG. 1 are a plurality of vertically depending angles such as indicated at 22 and 24. Third and fourth verticle angles depend from the component 10, but are not visible in the drawing as this portion of the apparatus has been excluded. The purpose of the angles 22, 24, etc. will be explained in greater detail hereinafter.

Also appearing in FIG. 1 is a locking element 26 mounted adjacent lip 28 depending from the rim 30 of component 10. The purpose of locking element 26 and lip 28 will be discussed hereinafter.

Component 12 of the display apparatus of the invention, includes a plurality of reflectors such as indicated, for example, at 40, 42, 44, 46, 48 and 50. Three additional reflectors are incorporated into the particular design as will be described hereinafter. Between the reflectors are a plurality of respective separators or opticl isolators such as indicated at 52, 54, 56, 58 and 60, there being additional separators between the remaining reflectors which are excluded in this view.

The reflectors and separators are joined together in a monolithic structure with at least the reflectors having a mirrored surface for the reflection and concentration of light as will be discussed in greater detail hereinafter.

It will be noted that the reflectors and separators are joined in a casing having ends 62 and sides 64 as well as flanges 66 and 68. The connection of component 12 with the component 10 will be described in greater detail hereinafter.

The component 14 of the display apparatus of the invention is also a casing. It includes sides 80 and 82 as well as a rearwardly positioned side 84 and a fourth side or end, not illustrated in FIG. 1. The component 14 includes a plurality of vertically oriented angles 86 and 88, these corresponding to the angles 22 and 24, etc. in component 10. These components are designed to mateably nest with one another as a consequence of which the components 10 and 14 can bse guided together and accurately positioned relative to one another. Also appearing in FIG. 1 are the receptacles 90 and 92. It will be seen that the receptacle 90 is adapted to accommodate the lip 28 of component 10 as well as the locking element 26 which constitutes a spring lock type latch whereby the components 10 and 14 are held together locking the component 12 therebetween as will be discussed in greater detail hereinafter.

It will be noted that the components 12 and 14 can be fabricated of plastic, but as well can be made of wood, rubber, metal and like materials having adequate strength and being adapted to resist the amount of heat which will be generated within these components by virtue of the utilization of bulbs or other such lights as will be discussed in greater detail hereinafter.

Figure 2:
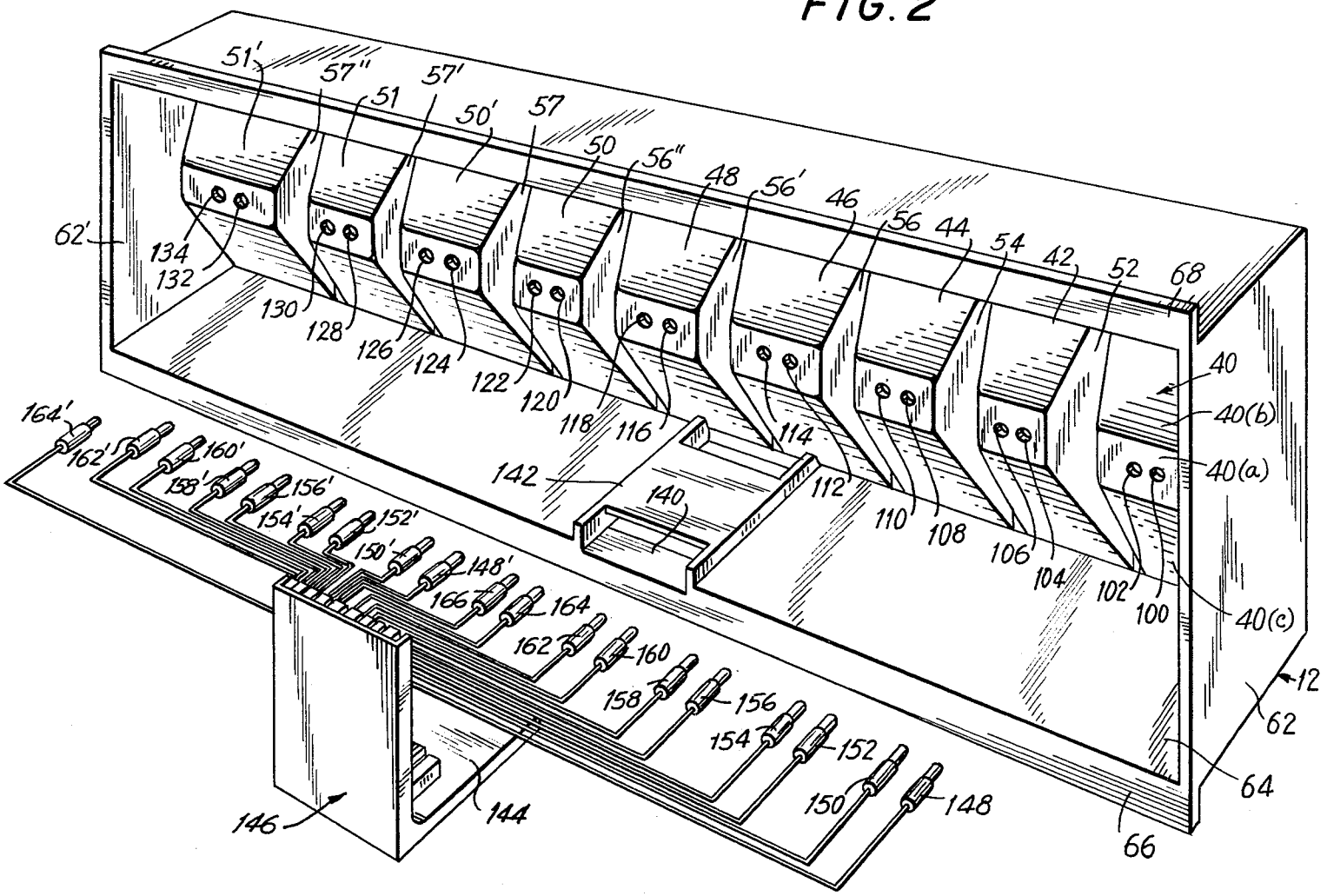
FIG. 2 is a rear perspective view of the apparatus illustrated in FIG. 1.

FIG. 2 is a rear perspective view of the component 12 of FIG. 1. Therein can be seen the flanges 68 and 66 as well as the side 62 and the opposed side 62′ not previously shown with respect to FIG. 1. Also seen in FIG. 2 are the reflectors 40, 42, 44, 46, 48 and 50, as well as the three reflectors 50′, 51 and 51′ which were not illustrated in FIG. 1.

Visible in FIG. 2 are the openings 100 and 102 for a pair of lights extending through reflector 40, openings 104 and 106 for the lights extending through reflector 42, openings 108 and 110 for the pair of lights extending through reflector 46, openings 112 and 114 for the pair of lights extending through reflector 46, openings 116 and 118 for the pair of lights extending through reflector 48, openings 120 and 122 for the pair of lights extending through reflector 50, openings 124 and 126 for the pair of lights extending through reflector 50′, openings 128 and 130 for the pair of lights extending through reflector 51 and openings 132 and 134 for the pair of lights extending through reflector 51′.

Also visible in FIG. 2 are the separators 52, 54, 56, 56′, 56″, 57, 57′ and 57″. In this view, it is more clearly apparent the the separators need not necessarily be flat planar members, but can instead be V-shaped members having one limb connected to one reflector and another limb connected to the next adjacent reflector.

Also appearing in FIG. 2 is the construction of the reflectors such that each reflector consists of a flat central portion having connected thereto angularly related end portions. The flat portion is, for example, illustrated at 40(*a*) whereas the end portions of this reflector which are disposed at an angle are indicated at 40(*b*) and 40(*c*). The shape and utilization of these reflectors will be discussed in greater detail hereinafter.

In the side 64 of the component 12 is located a receptacle 140, consisting of an opening partly covered by a bridge 142. This structure is intended to accomodate the insertion of one leg 144 of a power pack indicated generally at 146. The purpose of this power pack is to supply power in a unique sequence to the lights which are intended to be inserted through the various openings in reflectors, as has been described hereinabove. These lights are more particularly indicated in pairs, there being one pair for each reflector. More particularly, lights 148 and 150 are provided for reflector 40. Lights 152 and 154 are provided for reflector 42. Lights 156' and 158' are provided for reflector 50'' and lights 160' and 162' are provided for reflector 50'''. A further light 164' may be provided for a purpose to be indicated in greater detail hereinafter.

Figure 3:
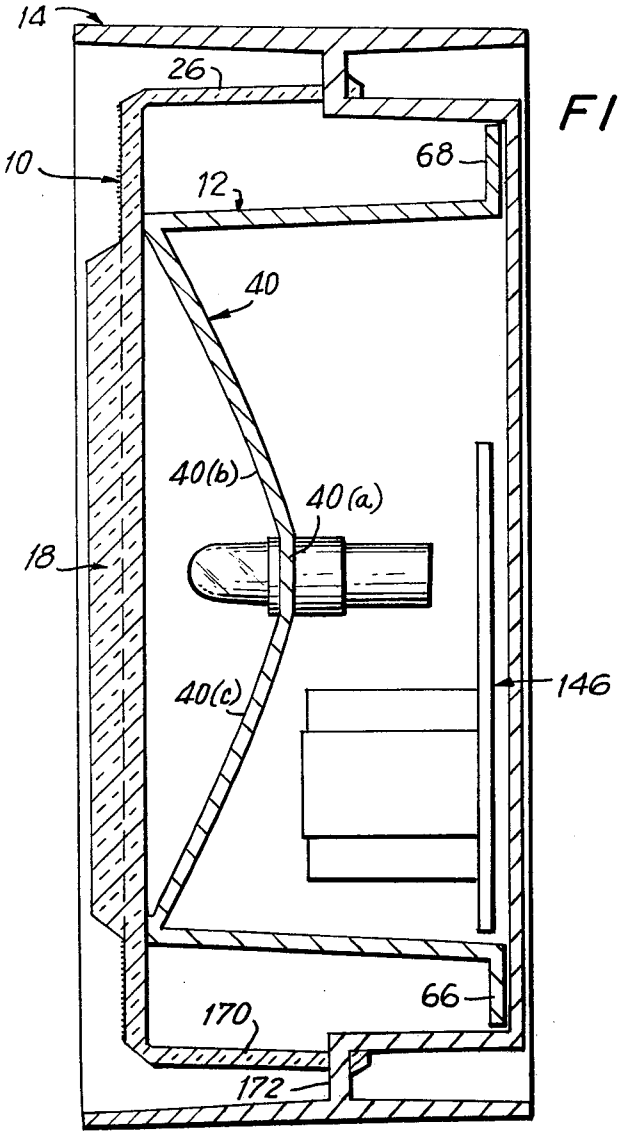
FIG. 3 is a sectional view taken perpendicular to the longitudinal axis of the apparatus illustrated in FIGS. 1 and 2.

A nesting assemblage of the components 10, 12 and 14 is illustrated in FIG. 3 wherein it is seen that the component 14 forms a casing for receiving the casing constituting the component 12 which is sandwiched within the component 14 and trapped therein by the component 14 whose shaped lenses (such as the illustrated lens 18) are superposed on the aggregate structure to be viewed from above.

FIG. 3, moreover, illustrates the relative arrangements of the reflectors and the various components thereof (such as the reflector 40 and its components **40*a*, 40*b*, 40*c***).

The power pack 146 is similarly visible in FIG. 3 as is the locking arrangement constituted by the locking element 26 and the receptacle 90, a corresponding locking element being visible on the opposite side as indicated at 170 and 172.

Figure 4:
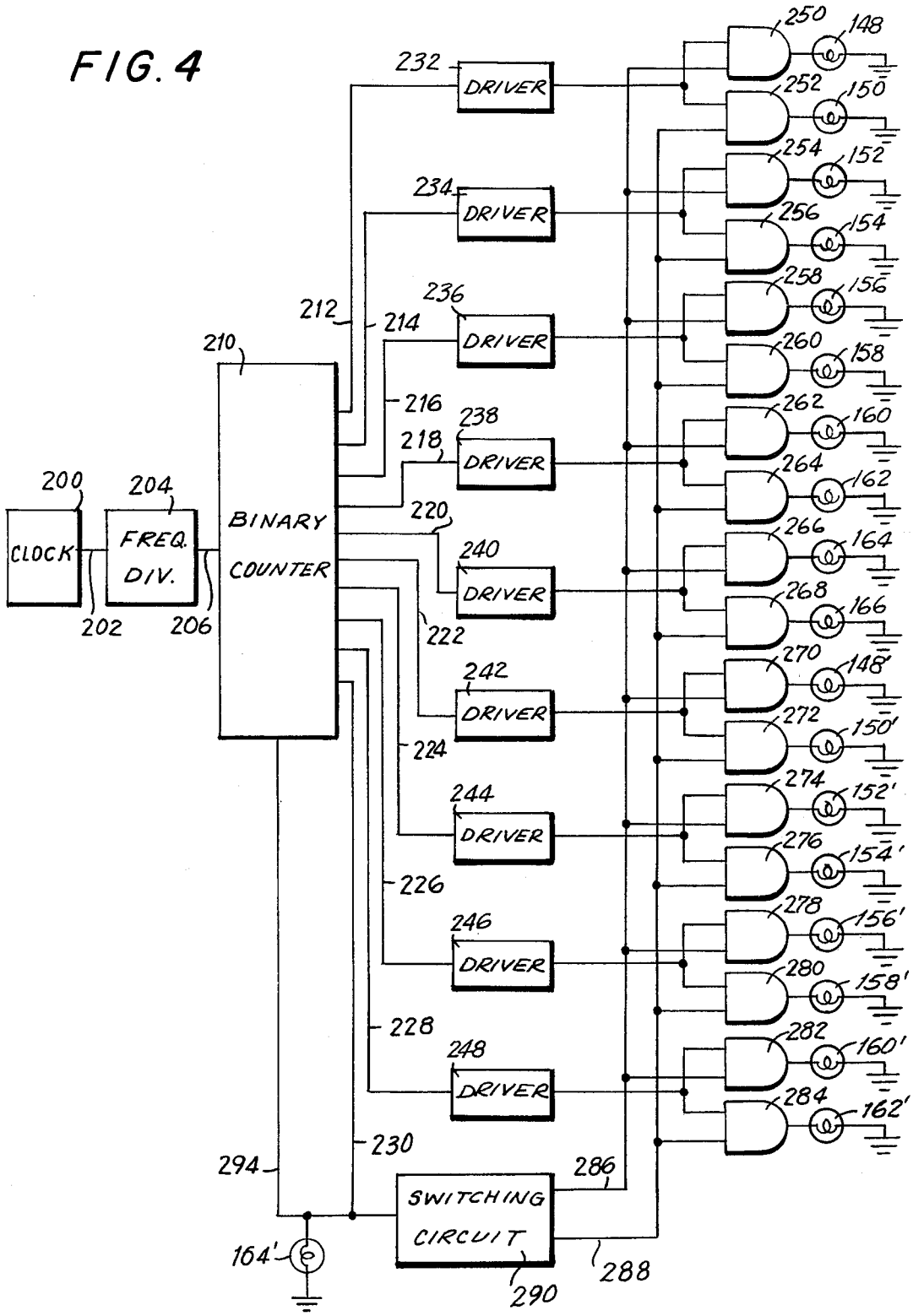
FIG. 4 is a block diagram of a circuit adapted to provide the sequencing of lights in the apparatus illustrated in FIGS. 1–3.

FIG. 4 illustrates a circuit comprised within the power pack 146 for purposes of actuating the two sets of lights previously discussed with reference to FIG. 2. In FIG. 4 can be seen the lights 148, 152, 156, 160, 164, 148', 152', 156' and 160' constituting one set of lights. Also can be seen lights 150, 154, 158, 162, 166, 150', 154', 158' and 162' constituting a second set of lights. It will be noted that one of these sets of lights may have a set of colored envelopes associated with the same so that one set of lights may be, for example, white and the other set of lights may be, for example, red. Also to be noted in FIG. 4 is the special purpose light 164' which will be discussed hereinafter.

The circuit of FIG. 4 comprises a clock circuit 200, the output of which is transmitted via line 202 to a frequency divider 204. The clock circuit 200 will generate a series of pulses at a fixed repetion rate which can be decreased by the frequency divider 204 in order to obtain the rate of change desired for the sequencing of the lights as will become clear directly hereinafter.

The frequency divider produces an output which is transmitted via line 206 to a binary counter 210. The binary counter, frequency divider, and clock circuits are all of conventional construction and adapted for being fabricated on a state of the art MOS or the like by various known techniques.

The binary counter 210 produces an output which is represented on output lines or terminals 212, 214, 216, 218, 220, 222, 224, 226, 228 and 230. These outputs will be represented in sequence by the partial table given below:

BINARY COUNTER TABLE

| | | | | | | | | | | |
|---|---|---|---|---|---|---|---|---|---|---|
| Step 1 | 1 | 0 | 0 | 0 | 0 | 0 | 0 | 0 | 0 | 0 |
| Step 2 | 0 | 1 | 0 | 0 | 0 | 0 | 0 | 0 | 0 | 0 |
| Step 3 | 1 | 1 | 0 | 0 | 0 | 0 | 0 | 0 | 0 | 0 |
| Step 4 | 0 | 0 | 1 | 0 | 0 | 0 | 0 | 0 | 0 | 0 |
| Step 5 | 1 | 0 | 1 | 0 | 0 | 0 | 0 | 0 | 0 | 0 |
| Step 6 | 0 | 1 | 1 | 0 | 0 | 0 | 0 | 0 | 0 | 0 |
| Step 7 | 1 | 1 | 1 | 0 | 0 | 0 | 0 | 0 | 0 | 0 |
| | . | | | | | | | | | |
| | . | | | | | | | | | |
| | . | | | | | | | | | |
| | . | | | | | | | | | |

-continued

BINARY COUNTER TABLE

| | | | | | | | | | | |
|---|---|---|---|---|---|---|---|---|---|---|
| | 1 | 0 | 1 | 1 | 1 | 1 | 1 | 1 | 1 | 0 |
| | 0 | 1 | 1 | 1 | 1 | 1 | 1 | 1 | 1 | 0 |
| | 1 | 1 | 1 | 1 | 1 | 1 | 1 | 1 | 1 | 0 |
| Final Step | 0 | 0 | 0 | 0 | 0 | 0 | 0 | 0 | 0 | 1 |

From the above, it will be seen that an output will be produced on line 212 at the first step of the counting, whereas the outputs will be absent from lines 214–230 at this stage of the counting. At step 2, a positive output will appear on line 214, whereas the output will be missing from lines 212 and the remaining output lines of binary counter 210 for the balance of step 2.

In each sequential step, the binary count represented by lines 212–230 will be a binary representation of the numerical value of the step. This will have the effect of selectively lighting different of the lights in a sequence corresponding to a binary count as will be further elucidated hereinbelow.

dIn order to supply appropriate power to the lights, there are furthermore provided a plurality of drivers of conventional conformation and circuitry. These drivers are indicated at 232, 234, 236, 238, 240, 242, 244, 246, and 248. These drivers are respectively connected to the different lights by way of AND gate circuits indicated at 250, 252, 254, 256, 258, 260, 262, 264, 266, 268, 270, 272, 274, 276, 278, 280, 282 and 284.

Each of the AND gates 250–284 has two input terminals. One of these input terminals is connected to the asociated driver. The other of these input terminals is connected to one or the other of two input lines 286 and 288 connected to switching circuit 290.

The object of the gate circuits mentioned hereinabove, is to selectively enable the driving or actuation of one set of lights or the other set of lights mentioned hereinabove thereby to sequence a set of, for example, white lights or a set of red lights, depending on the color combination which is employed.

Whether one set of lights or the other set of lights is to be actuated is controlled by the switching circuit 290 which in turn is driven by the signal appearing on the line 230 which is actuated according to the final step in the above listed binary counter table. The actuation of the switching circuit 290 is indicated by the actuation of light 164' and at the same time a signal is transmitted back to the binary counter 210 via line 294 in order to reset the binary counter 210 and commence the count all over again according to the binary counter table set forth hereinabove.

From the above, it will be seen that, by the utilization of a relatively small circuit adapted to be physically positioned in a relatively small space, provision can be made for the sequencing of a plurality of lights which in turn are associated with lenses shaped appropriately as alphabetic characters or the like, with the option being provided of generating one sequence in one light and a second sequence in another light. As a matter of fact it will be readily appreciated, from what has been stated above, that a multitude of different sequences involving different lights can be readily provided in accordance with the invention at relatively low cost and with the absence of mechanical devices which necessitate frequent maintenance and repair operations.

Figure 5:
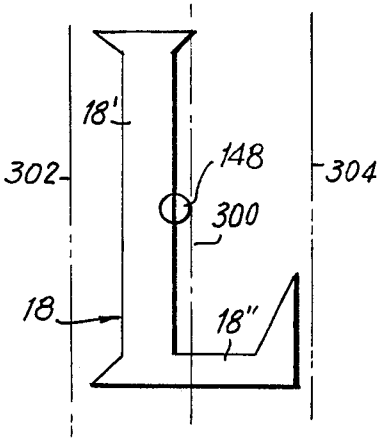
FIG. 5 is a plan view of an alphabetic character employed in the apparatus of FIGS. 1–3, FIGS. 5(*a*) and 5(*b*) being diagrammatic views corresponding to sections through the reflector associated with the shaped lens of FIG. 5.
Figure 5A:
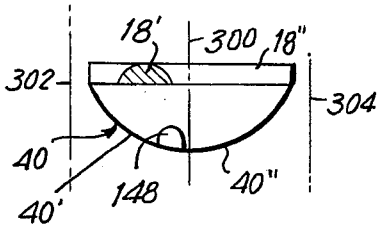
Figure 5B:
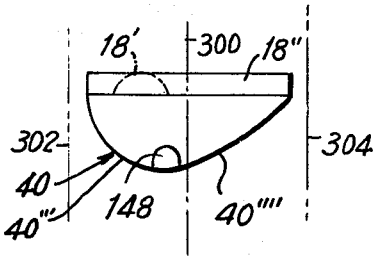

FIGS. 5, 5*a* and 5*b* illustrate the relationship of a particular lens with the cross sections of the associated reflector. Thus, by way of example, lens 18 is shown in conjunction with sections of the associated reflector 40 as illustrated in FIGS. 5(*a*) and 5(*b*). More particularly, the lens 18 is in the shape of an L having a vertical stem 18' and a horizontal stem 18''. One of the bulbs, namely light 148, is shown in relationship to the center line 300 of the field of the lens 18, the left boundary and the right boundary of the field being respectivley indicated at 302 and 304. Thus it may be seen that the bulb 148 is asymmetrically located relative to the center line at 300 and that the verticle stem 18' is also asymmetrically arranged relative to this center line. On the other hand, the horizontal stem 18'' may generally be regarded as being symmetrically arranged relative to the center line 300 or at least relatively symmetrical with respect thereto, since there is an equal extent of this horizontal stem 18'' to either side of the center line 300.

Inasmuch as the horizontal stem 18'' is relatively symmetrically arranged with respect to center line 300, the portion of the reflector 40 associated therewith and illustrated in FIG. 5(*a*) can also be symmetrically designed. Thus, part 40' is essentially a mirror reflection of part 40'', at least as regards the portion of the reflector 40 illustrated in FIG. 5(*a*).

However, with respect to FIG. 5(*b*) this illustrates the correspondance to the stem 18' as illustrated in comparison with the previously described portion of reflector 40. Herein it is seen that half 40''' is not a mirror image of half 40'''' and in fact, the half 40''' is more lobe shaped while the half 40'''' is more shallow, thereby enabling a greater amount of light to be reflected through lens portion 18', all in the interest of providing a maximum amount of light to be directed through the various lens portion to achieve the brightness and clarity referred to hereinabove.

From what has been stated hereinabove, it will now be appreciated that there is provided, in accordance with the invention, a special lens and reflector arrangement, as well as a control circuit arrangement, all of which provides for a unique type of sequencing at relatively low cost and low ,maintenance while at the same time, an effective and decorative spectacular lighting arraangement is achieved all with a construction technique which is readily adapted to mass production techniques therefore results in relatively low cost, There will now be obvious to those skilled in the art many modifications and variations of the structures and circuits set forth hereinabove. These modifications and variations will not depart from the scope of the invention if defined by the following claims.

What is claimed is:

1. Apparatus comprising a plurality of spaced lights, reflectors operatively associated with respective of said lights, first means for optically isolating said light, second means for actuating said lights for selected periods of time to create an appearance of sequencing, and third means for displaying indicia, said means optically associated with respective of said lights to be illuminated thereby, said apparatus further comprising a casing for supporting the reflectors, first and third means, said reflectors and first means being captured between said casing and third means, said third means including shaped lenses, a pair of said lights being provided for each of said reflectors and one of each pair of said lights including a colored lens for change of color, said lights forming two sets, one of the sets including said colored lens, said second means including a clock circuit generating a sequence of pulses and a binary counter to count said pulses and to actuate said lights according to the count, said counter being adapted to selectively actuate at least one of the lights associated with each reflector at a time dependent upon the count, said counter alternating back and forth between said sets

2. Apparatus as claimed in claim 1 wherein the shaped lenses are in the shape of alphabetic characters.

3. Apparatus as claimed in claim 1 wherein said reflectors and first means are connected together in a monolithic structure.

4. Apparatus as claimed in claim 3 wherein said lights extend through said reflectors.

5. Apparatus as claimed in claim 4 wherein said reflectors each include a relatively flat base and opposite end portions extending angularly from said base, said base being provided with openings for said lights.

6. Apparatus as claimed in claim 5 wherein at least one of said shaped lenses is at least partly asymmetrically shaped in at least one cross section and at least one of said end portions is at least partly asymmetrically shaped in at least one cross section to optimize light diverted through said lenses.

7. Apparatus as claimed in claim 6 wherein said end portions are at least partly symmetrically shaped about the base in at least one cross section.

8. Apparatus as claimed in claim 1 comprising cooperating locking means on said casing and third means to hold the same together.

9. Apparatus as claimed in claim 1 wherein said second means includes a power pack to supply power to said lights in parallel and means for selectively connecting said power to and isolating said power from said lights.

10. Apparatus as claimed in claim 9 wherein said second means includes a clock circuit generating a sequence of pulses and a binary counter to count said pulses and to actuate said lights according to the count.

11. Apparatus as claimed in claim 1 wherein said counter includes a plurality of output terminals exceeding by one in number the number of said pairs of lights, said second means further comprising a switching circuit actuated by the extra output terminal to switch between said sets.

12. Apparatus as claimed in claim 11 comprising driver circuits between said counter and said lights.

* * * * *